United States Patent [19]

Suga

[11] 4,003,615

[45] Jan. 18, 1977

[54] COATED CARBON ELECTRODE HAVING AN INNER COATING OF LOW RESISTANCE MATERIAL

[76] Inventor: Shigeru Suga, Yoyogi 5-20-2, Shibuya, Tokyo, Japan

[22] Filed: Jan. 12, 1976

[21] Appl. No.: 648,162

[30] Foreign Application Priority Data

Feb. 3, 1975 Japan ..... 50-14693

[52] U.S. Cl. ..... 314/60

[51] Int. Cl.[2] ..... H05B 31/10

[58] Field of Search ..... 13/18; 314/60; 219/146; 313/355, 354

[56] References Cited

UNITED STATES PATENTS

| | | | |
|---|---|---|---|
| 3,461,339 | 8/1969 | Robiette et al. | 13/18 |
| 3,476,586 | 11/1969 | Valtchev et al. | 13/18 X |
| 3,867,667 | 2/1975 | Suga | 13/18 X |

*Primary Examiner*—R. N. Envall, Jr.

*Attorney, Agent, or Firm*—Wenderoth, Lind & Ponack

[57] ABSTRACT

A carbon electrode for use in an arc lamp used for determining light fastness which has a central core of light emitting material combined with stabilizers and graphite surrounded by a first coating of low resistance electrically conductive material, preferably copper or aluminum. The thus-coated core is further coated with a second coating of graphite and adhesive and inserted into a cylindrical carbon tube. The tube, except for the top and bottom portions is coated around the outside with a third protective coating, and the base and bottom portions of the tube are coated with a metallic coating electrically connected to the first coating of low resistance material spaced from the third coating. The third and fourth coatings may be joined together, provided that the resistance of these two coatings is greater than the resistance of the first coating.

10 Claims, 8 Drawing Figures

COATED CARBON ELECTRODE HAVING AN INNER COATING OF LOW RESISTANCE MATERIAL

The device of the present application is related to the construction of a carbon electrode that is to be used in a carbon arc lamp used in light fastness testers. In this new device, a metal coating is provided between the central core and a surrounding carbon layer so that the light discharge will be very stable in comparison to conventional carbon electrodes.

BACKGROUND OF THE INVENTION

At the present time, conventional arc lamps are providing the light source for light fastness testers are constructed as shown in FIG. 1. The lower electrode holding part 1 has four carbon electrodes mounted thereon, and an upper electrode holding part likewise has four carbon electrodes mounted thereon directed downward toward the carbon electrodes mounted on the lower holding part 1. Light discharge between the upper and lower electrodes occurs when the distance between the two holding parts is automatically adjusted by means of a servo motor 5, a chain 3 and a gear 4. A specimen to be tested for light fastness is placed in the vicinity of the lamp.

Conventional carbon electrodes used in the above described arc lamp generally have a light emitting material or a central core which is surrounded by carbon material. The carbon material is, itself, coated with a copper coating around the sides and across the bottom. The tip of the conventional electrode is not copper-coated.

The problem with these conventional carbon electrodes is that they have a relatively short burning life, and more importantly, they do not have suitably stable light emitting qualities. As the carbon tube material of these conventional electrodes is consumed during discharge between the electrodes, the discharge emitting the light moves from the outer carbon toward the central core, thus changing the location of the bright spot of the emitted light. As the bright spot moves, the properties of the emitted light differs spectrally.

SUMMARY OF THE INVENTION

It is the object of the present invention to provide a carbon electrode in which the light emitting core and the carbon theresurrounding burn uniformly to produce a stable, unvarying light, and which has a greatly extended burning time in comparison to conventional carbon electrodes.

To meet this objective, the carbon electrode of the present invention is provided with a round, bar-shaped central core of light emitting material, a first coating of low electrical resistance metal covering this central core, a tubular carbon cylinder into which the central core and the first coating are inserted, and finally, an additional coating of metal or resin covering the sides of the carbon cylinder and in electrical contact with the first metal coating within the carbon cylinder. The tip, however, is left uncoated by this additional coating. Since the first coating has the lowest electrical resistance, the bright spot of the arc between two of these electrodes will form thereinbetween and remain there, thus consuming the electrode uniformly and producing a stable light.

BRIEF DESCRIPTION OF THE DRAWINGS

Further objects and features of the present invention will be apparent from the following description taken with the accompanying drawing, wherein.

DETAILED DESCRIPTION OF THE PRESENT INVENTION

Figure 1:
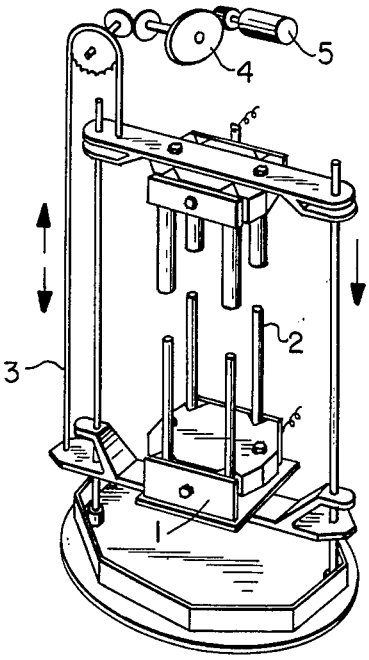
FIG. 1 shows a conventional carbon arc lamp for light fastness testers.
Figure 2:
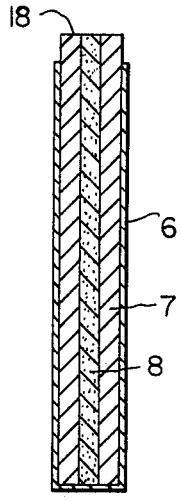
PRIOR ART FIG. 2
FIG. 2 shows a cross-sectional view of a conventional carbon electrode used in light fastness testers.

The conventional carbon electrode is shown in FIG. 2. In that electrode, a core 8 of light emitting material is surrounded by carbon material 7. Around both the sides and the bottom of this carbon material 7 and core 8 is a copper coating 6. The coating 6 does not, however, extend to cover the electrode tip 20.

Figure 3:
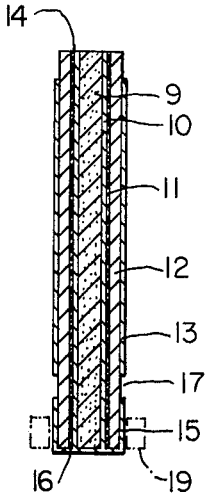
FIG. 3 is a cross-sectional view of a carbon electrode according to the present invention.
Figure 4:
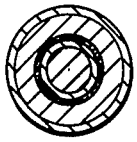
FIG. 4 is a plan view of the carbon electrode according to the present invention.

In comparison to the conventional electrode of FIG. 2 is the carbon electrode of the present invention disclosed in FIG. 3. The central core portion 9 of the present invention is a round bar formed from a mixture of suitable light emitting material, such as cerium fluoride, with a stabilizer material, such as potassium sulfate, and graphite. This mixture is calcined at a temperature of 500° – 1000° C. Covering the sides of the central core portion 9 is a first coating 10 of low electrical resistance electrically conductive material, such as copper or aluminum. This first coating 10 is provided by suitable coating methods such as electroplating or evaporation coating. A second coating 11 containing an electrically conductive adhesive, such as a phenol resin, mixed with graphite covers the first coating 10 of electrically conductive material. A cylindrical tube 12 is formed and calcined from carbon material, such as carbon black. The previously formed central core 9 coated with the first and second coatings 10 and 11 is forceably inserted into the cylindrical tube 12 and, then, is dried and adhered thereto. A third coating of metal, such as copper, aluminum or any other metal, or resin 13 covers the sides of the electrode surrounding the cylindrical tube 12. The resinous coating 13 may be of resins such as phenol resins. The tip 14 is not coated with a third coating 13 to allow for easy discharging. Finally, a fourth coating 15 of conductive metallic material, such as copper or aluminum, covers the lower portion of electrode which will be held within an electric holder 13. This fourth coating 15 is also electrically connected to the first coating 10 of the core portion at the bottom 16, in a manner such as electroplating.

The fourth coating 15 is electrically separated from the third coating 13 by a suitable distance 17 if the central core 9 and the cylindrical tube 12 are made of the same material, and when the third and fourth coatings are of the same metallic material (copper or aluminum) the space is also necessary.

However, when the third and fourth coatings 13, 15 are of different metallic materials (the third coating 13 being anything but copper or aluminum) the space inbetween is unnecessary, but, an adjustment in the thickness of the third coating 13 may be necessary, because the resistance of the third coating 13 must be greater than that of the first coating 10. If the third coating is not a metallic material, but is a heat resistive resin, the spacing between the third and fourth coatings is also unnecessary.

By constructing the electrode according to this arrangement and with these materials, the resistance and hence the electrical flow through the electrode is altered from the electrical flow found in the conventional electrodes. Even when graphite having good electrical conductivity is used to form the central core portion 9, the mixing of the light emitting material, such as cerium fluoride, therewith greatly increases the electrical resistance in the central core portion 9. In fact, a central core portion 9 of approximately 30 centimeters will have the resistance of several ohms. At the same time, the cylindrical tube 12 of carbon black will have a relatively small resistance, probably less than 0.5 ohm. Most significant, however, is the effect to the resistance of the electrode by employing the first coating 10. The resistance between the first coating 10 and the central core portion 9 and the resistance between the carbon tube 12 and the first coating 10 are both generally less than 0.2 ohm.

Figure 7:
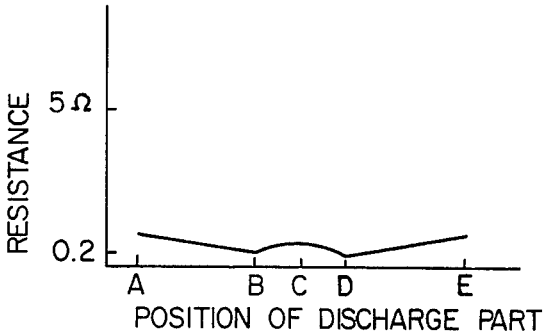
FIG. 7 is a diagram showing resistances in the direction of the diameter of the carbon electrode of the present invention.

The relationships of the resistances across the length of the electrode of the present invention are shown in FIG. 7. The symbol "A" represents the outside of the carbon tube 12, "B" represents the first coating 10 on the boundary between the central core portion 9 and the carbon tube 12, "C" is at the central part of the central core portion 9, "D" is at the boundary symmetrical with "B" and "E" is at the outer part symmetrical to "A". As is apparent from the diagram, the resistance is smallest at the boundary parts B and D, the first coating 10.

Figure 8:
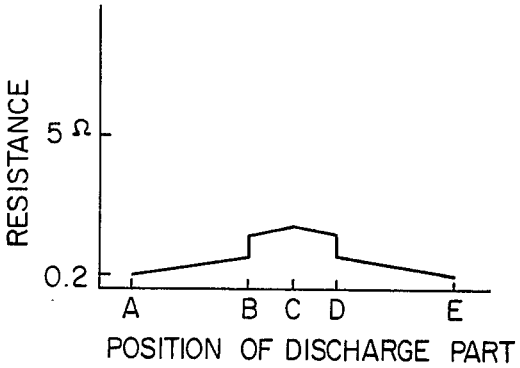
PRIOR ART FIG. 8
FIG. 8 is a diagram of resistances in the direction of the diameter of a conventional carbon electrode.

With reference to the relationship of the resistances of the conventional carbon electrodes, reference is made to FIG. 8. The conventional carbon electrodes which do not have the first coating 10 of copper or aluminum around the central core portion therein have a greater contact resistance between the central core portion 8 and the central tube 7, and the resistance of the central core portion itself aids to increase the resistance at the core parts B, C and D as shown in FIG. 8.

Figure 5:
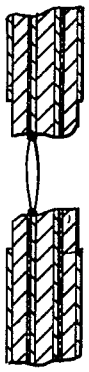
FIG. 5 is a diagram showing the discharging state of the carbon electrode of the present invention.
Figure 6:
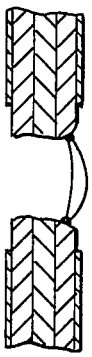
PRIOR ART FIG. 6
FIG. 6 is a diagram showing the discharging state of the conventional carbon electrode.

When actually discharged, the carbon electrode of the present device assumes the state as shown in FIG. 5. That is, since the first coating 10 surrounding the central core portion 9 has the smallest electrical resistance, the bright point of the arc inevitably developes at this boundary point, and the discharge is sustained at the boundary part. Therefore, the light emitting material of the central core portion and the cylindrical tube 12 burn uniformly, produce a very stable light, and extend the burning time of the electrode as compared to the conventional electrode counterparts.

The discharging state of the conventional carbon electrodes is shown in FIG. 7. Since the lowest resistance through the conventional electrode is through the carbon tube 7, the carbon tube is worn down in use due to large quantities of discharge between the carbon tubes. During the burning process, discharge moves from the outside toward the central core 8, thereby relocating the bright point of the art considerably. Furthermore, the properties of light differ spectrally depending upon the location of the bright point in relation to the central core part 8 and the carbon tube 7.

However, as mentioned above, by using an electrode of the present type having an area of reduced electrical resistance between the core portion and the surrounding carbon portion, the bright point of the arc remains stationary and the light emitted is very stable. In fact, it is possible to obtain a definite quantity of light within an accuracy of 1% at a discharge of 50 volts, 60 amps as specified by the Japanese Industrial Standards. When the carbon electrode of the present invention is used in an arc lamp for a color fastness tester, it is possible to quite accurately determine the color fastness of objects placed in the vicinity thereof.

It will be apparent that various modifications may be made to the above specifically described structural arrangements without departing from the scope of this invention.

What is claimed is:

1. A carbon electrode for use in an arc lamp used for determining light fastness, said carbon electrode comprising:

a round central core portion comprised of a mixture of:
light emitting materials,
stabilizer material, and
graphite;

a first coating of low resistance electrically conductive material covering the outside, but not the ends, of said central core portion;

a second coating of adhesive and graphite surrounding said first coating;

a cylindrical carbon tube with said first and second coated central portion inserted, dried, and adhered thereinto;

a third protective coating surrounding the outside of said cylindrical carbon cylinder above the bottom of said carbon cylinder and beneath the top end of said carbon cylinder; and a fourth metallic coating covering the bottom end of said first and second coated central core and said carbon tube and surrounding the outside base of said cylindrical carbon tube, spaced from said third coating, electrically connected to said first coating and having a higher electrical resistance than said first coating.

2. A carbon electrode as claimed in claim 1, wherein:
said light emitting material is cerium fluoride;
said stabilizer is potassium sulfate; and
said mixture of light emitting material, stabilizer and graphite is calcined at a temperature of 500° to 1000° C.

3. A carbon electrode as claimed in claim 1, wherein said first coating is selected from the group consisting of copper and aluminum.

4. A carbon electrode as claimed in claim 1 wherein said cylindrical carbon tube is comprised of carbon black.

5. A carbon electrode as claimed in claim 1 wherein said third coating is comprised of a resin.

6. A carbon electrode as claimed in claim 1 wherein said third coating is comprised of a metal.

7. A carbon electrode as claimed in claim 6, wherein said third coating is selected from the group of metals consisting of copper and aluminum.

8. A carbon electrode as claimed in claim 1 wherein said fourth coating is selected from the group consisting of aluminum and copper.

9. A carbon electrode as claimed in claim 1 wherein said third and fourth coatings are comprised of different metal material, are joined together to form one continuous coating electrically connected to said first coating, said combined third and fourth coatings having an electrical resistance greater than the resistance of said first coating.

10. A carbon electrode as claimed in claim 1 wherein said third coating is a resin; said fourth coating is a metal; and said third and fourth coatings are joined together, whereby a continuous coating electrically connected to said first coating is formed.

* * * * *